US008270297B2

(12) United States Patent
Akasaka et al.

(10) Patent No.: US 8,270,297 B2
(45) Date of Patent: Sep. 18, 2012

(54) DATA COMMUNICATION DEVICE, DATA COMMUNICATION METHOD AND PROGRAM THEREOF

(75) Inventors: Koichi Akasaka, Iwate (JP); Shinji Katsuki, Tokyo (JP)

(73) Assignee: Sony Corporation, Tokyo (JP)

( * ) Notice: Subject to any disclaimer, the term of this patent is extended or adjusted under 35 U.S.C. 154(b) by 624 days.

(21) Appl. No.: 11/858,404

(22) Filed: Sep. 20, 2007

(65) Prior Publication Data

US 2008/0084823 A1 Apr. 10, 2008

(30) Foreign Application Priority Data

Oct. 6, 2006 (JP) ..... 2006-275073

(51) Int. Cl.
*G08C 15/00* (2006.01)

(52) U.S. Cl. ..... 370/235; 370/311

(58) Field of Classification Search ..... 370/235, 370/280, 419, 331, 311; 713/322, 600; 455/76
See application file for complete search history.

(56) References Cited

U.S. PATENT DOCUMENTS

| | | | | |
|---|---|---|---|---|
| 6,049,882 | A * | 4/2000 | Paver | 713/322 |
| 6,208,624 | B1 * | 3/2001 | Tanno et al. | 370/280 |
| 6,898,438 | B1 | 5/2005 | Uchida | |
| 7,035,596 | B2 * | 4/2006 | Sato | 455/76 |
| 7,602,799 | B2 * | 10/2009 | Ikeda et al. | 370/419 |
| 2005/0213538 | A1 * | 9/2005 | Ebiko et al. | 370/331 |
| 2007/0162780 | A1 * | 7/2007 | Wang et al. | 713/600 |

FOREIGN PATENT DOCUMENTS

| | | |
|---|---|---|
| JP | 2000-101509 | 4/2000 |
| JP | 2000-357987 | 12/2000 |
| JP | 2002-135203 A | 5/2002 |
| JP | 2007-524316 A | 8/2007 |

* cited by examiner

*Primary Examiner* — Anh-Vu Ly
*Assistant Examiner* — Gbemileke Onamuti
(74) *Attorney, Agent, or Firm* — Oblon, Spivak, McClelland, Maier & Neustadt, L.L.P.

(57) ABSTRACT

A communication device includes a communication unit having plural function operation units performing communication with an external device at plural prescribed communication speeds, and a control unit allowing the communication unit to receive a given kind of content data from the external device, estimating an optimum prescribed communication speed in which the power consumption amount becomes smallest from the plural prescribed communication speeds based on a bit rate of the content data, selecting a given function operation unit from the plural function operation units based on the estimated optimum communication speed, allowing the selected function operation unit to receive the given kind of content data at the estimated prescribed communication speed and controlling power consumption to the function operation units other than the function operation unit selected from the plural function operation units to be less than a fixed value.

22 Claims, 9 Drawing Sheets

FIG. 4

| PRESCRIBED COMMUNICATION SPEED (Mbps) | MODULATION METHOD |
|---|---|
| 54 | OFDM |
| 48 | |
| 36 | |
| 24 | |
| 18 | |
| 12 | |
| 9 | |
| 6 | |
| 11 | CCK |
| 5.5 | |
| 2 | DSSS |
| 1 | |

FIG. 6

| PRESCRIBED COMMUNICATION SPEED (MODULATION METHOD) [Mbps] | POWER CONSUMPTION IN TRANSMISSION [W] | POWER CONSUMPTION IN RECEPTION [W] | STANDARD COMMUNICATION TIME [sec] | RETRY OCCURRENCE PROBABILITY [%] |
|---|---|---|---|---|
| 54 (OFDM) | | | | |
| 48 (OFDM) | | | | |
| 36 (OFDM) | | | | |
| 24 (OFDM) | | | | |
| 18 (OFDM) | | | | |
| 12 (OFDM) | | | | |
| 11 (CCK) | | | | |
| 9 (OFDM) | | | | |
| 6 (OFDM) | | | | |
| 5.5 (CCK) | | | | |
| 2 (DSSS) | | | | |
| 1 (DSSS) | | | | |

DATA COMMUNICATION DEVICE, DATA COMMUNICATION METHOD AND PROGRAM THEREOF

CROSS REFERENCE TO RELATED APPLICATIONS

The present invention contains subject matter related to Japanese Patent Application JP 2006-275073 filed in the Japanese Patent Office on Oct. 6, 2006, the entire contents of which being incorporated herein by reference.

BACKGROUND OF THE INVENTION

1. Field of the Invention

This invention relates to a data communication device which is capable of performing, for example, data communication and a method thereof.

2. Description of the Related Art

In recent years, devices for performing data communication by wireless such as a wireless LAN (Local Area Network) are widely used. Since it is not necessary to connect communication equipment with cables for data communication in such a wireless data communication, there is little limitation on moving communication equipment. Therefore, a function of the wireless data communication is often given to portable equipment. Generally speaking, it is preferable that power consumption of electronic equipment is reduced as much as possible. In particular, as the portable equipment is usually driven by batteries, there is necessity to extend battery lifetime to extend operable time of equipment, therefore, the reduction of power consumption is strongly expected. Consequently, a configuration in which operation, for example, at unnecessary high communication speed is prevented in equipment which can perform wireless communication or a configuration in which communication speed is adjusted by limiting the maximum data transmission speed to control the power consumption are known as disclosed in JP-A-2000-101509 and JP-A-2000-357987 (Patent Documents 1 and 2).

SUMMARY OF THE INVENTION

It is desirable to suppress the power consumption in data communication equipment, for example, it is desirable to obtain higher suppressive effect as compared with related arts.

According to an embodiment of the invention, a data communication device is configured as follows. That is to say, the data communication device is configured to have a data communication means for executing data communication at one prescribed communication speed selected from plural prescribed communication speeds, including two or more communication-related function operation units executing given function operations which are necessary corresponding to data communication at given one or more prescribed communication speeds, a content data acquisition control means for receiving and acquiring a given kind of content data transmitted from another data communication device by data communication by the data communication means, a communication speed estimation means for estimating an optimum prescribed communication speed in which a power consumption amount is smallest when transmitting certain object content data from plural prescribed communication speeds based on a bit rate of the object content data which is content data received and acquired by the data communication means, a prescribed communication speed control means for controlling the data communication means so that data communication at communication speed corresponding to the optimum prescribed communication speed which is the prescribed communication speed estimated by the communication speed estimation means is executed with respect to another data communication device and a power control means for controlling power consumption in all or part of communication-related function operation units other than the communication-related function operation unit executing the operation for data communication at the optimum prescribed communication speed to be less than a fixed value.

The prescribed communication speed means communication speed prescribed, for example, in actual a data communication standard to which the embodiment of the invention is applied. The bit rate represents the data amount and the information amount per unit time concerning content data as video, audio and the like, which varies depending on, for example, a compression rate.

A data communication device according to the above configuration is capable of performing data communication at plural prescribed communication speeds, including plural communication-related function portions executing given function operations concerning communication corresponding to given one or more prescribed communication speeds so as to correspond to plural prescribed communication speeds. The data communication device can receive and acquire content data transmitted from at least another data communication device according to the data communication function. The prescribed communication speed indicates communication speed prescribed, for example, in the actual data communication standard to which the embodiment of the invention is applied. When the content data is received and acquired, an optimum prescribed communication speed which is the prescribed communication speed in which the power consumption amount becomes smallest when transmitting the content data is estimated based on a bit rate of the content data. It is known that electric power for data communication varies depending on, for example, the difference of physical layer standards (hardware configuration) according to the prescribed communication speed, the set prescribed communication speed when the hardware configuration is the same, further, actual time during which data transmission and reception is performed and the like. The prescribed communication speed to be minimally necessary for transmitting the content data is determined according to the bit rate of the content data. Therefore, it is possible to select one prescribed communication speed in which power consumption is estimated to be smallest from prescribed communication speeds determined according to the bit rate, based on the bit rate of the content data. In the embodiment of the invention, communication for transmitting and receiving content data at the prescribed communication speed (optimum prescribed communication speed) estimated as the above is executed, and concerning the communication-related function portions other than the communication-related function portion operating according to the optimum prescribed communication speed, power consumption in these portions is made to be less than a fixed value. That is, the embodiment of the invention intends to suppress power consumption in the communication-related function portions not used for communication operation.

According to the above, the embodiment of the invention, first, intends to temporarily reduce power consumption by setting the prescribed communication speed (optimum prescribed communication speed) in which the power consumption amount becomes smallest according to the bit rate of content data, and further, intends to positively reduce power consumption at communication-related function portions which are not used. According to the embodiment of the invention, reduction effects of power consumption which is more efficient than related arts can be obtained.

BRIEF DESCRIPTION OF THE DRAWINGS

FIG. 4 is a table showing a correspondence example between communication speeds (prescribed communication speeds) prescribed in a given wireless LAN standard and carrier modulation methods;

FIG. 6 is a table showing the content example of a communication speed correspondence characteristic table stored in a system control unit;

DESCRIPTION OF THE PREFERRED EMBODIMENTS

Figure 1:
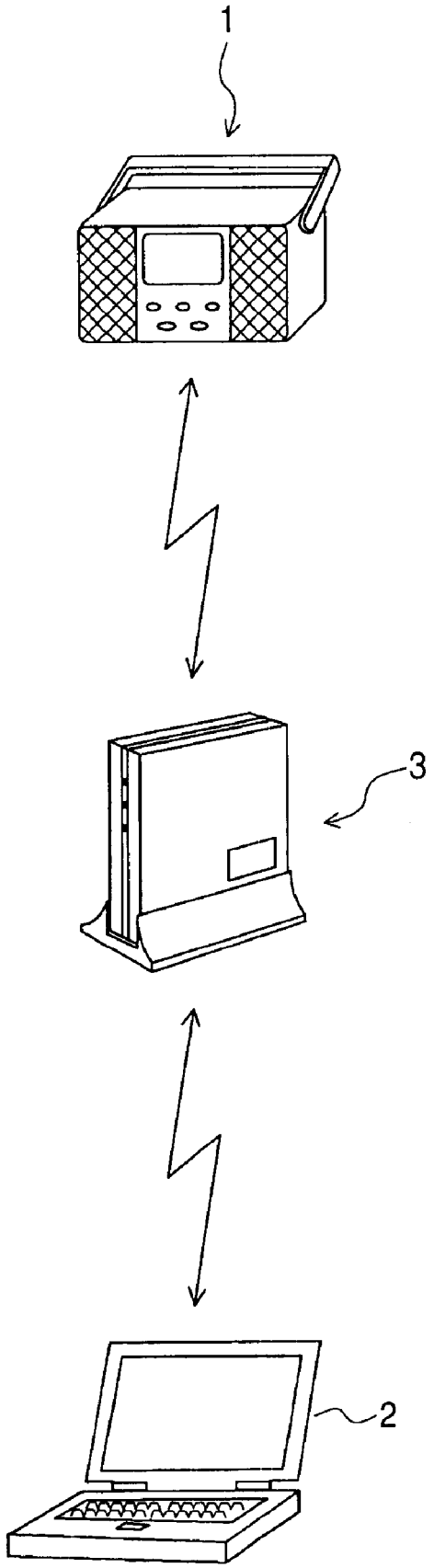
FIG. 1 is a view showing an example of an audio listening system configured including an audio playback device as a data communication device according to an embodiment of the invention.

Hereinafter, the preferred embodiments for realizing the invention (hereinafter, referred to as embodiments) will be explained. FIG. 1 shows a construction example of an audio listening system as an embodiment. The audio listening system shown in the drawing includes an audio playback device 1, an audio server device 2 and a wireless LAN access point 3. A configuration as a wireless data communication device according to the embodiment of the invention is applied to the audio playback device 1. The audio playback device 1 and the audio server device 2 are capable of performing data communication by a given wireless LAN standard. In this case, the wireless data communication between the audio playback device 1 and the audio server device 2 is a system configuration performed via the wireless LAN access point 3.

In the audio server device 2, a large amount of audio data having the playback contents such as music pieces and the like can be managed and stored, for example, in units of files by providing with a large-capacity storage medium such as a HDD (hard disc drive). In the following description, audio data files stored in units of files in the audio server device 2 as described above are files belonging to a content type of audio, therefore, regarded as audio content files. The audio playback device 1 transmits and outputs requested audio content file data to a request source from the stored audio content files according to the request of the audio content via the data communication network. Accordingly, the audio server device 2 functions as a server which provides audio content files in the audio listening system of the embodiment. As actual equipment of the audio server device 2 may be configured as a dedicated device having the audio server function as described above, or may be a personal computer in which application programs for realizing the audio server function are installed as well as having a data communication function which is capable of performing data communication with the audio playback device 1 of the embodiment in included.

The audio playback device 1 can request an audio content file with respect to the audio server device 2 via the data communication network as described above. Then, the audio playback device 1 is capable of playing back audio while receiving audio content file data transmitted via the same data communication network in response to the request.

The audio playback device 1 of the embodiment is portable, having the size and weight in which the user can carry the device easily. Accordingly, for example, the user can carry the audio playback device 1 to a discretionary place within distance range in which communication with the wireless LAN access point 3 is possible, and can listen to playback audio of the audio content file there. For example, when the user uses the audio listening system of the embodiment indoors, the user can listen to music and the like, carrying the audio playback device 1 to favorite places in the house freely.

As a configuration example of the audio listening system is not limited to the example shown in FIG. 1. For example, the simplest configuration example in which one audio playback device 1 and one audio server device 2 are included is shown in FIG. 1, however, a system configuration in which one audio playback device 1 and two or more audio server devices 2 are included, or a system configuration in which one audio server device 2 and two or more audio playback devices 1 are included can be configured. As correspondence to the embodiment of the invention, it is preferable that the audio playback device 1 to which a wireless data communication device as the embodiment of the invention is applied can receive and acquire audio content files by the wireless data communication, and it is not always necessary that the whole communication pathway from the audio server device 2 to the audio playback device 1 has to be the wireless data communication. Therefore, for example, under the system configuration of FIG. 1, it is also preferable that the audio server device 2 is connected to the wireless LAN access point 3 via a cable network (for example, Ethernet (Registered Trademark)). In addition, the wireless LAN access point 3 can be configured based on, for example, well-known techniques. Through standards of the wireless data communication mounted on the audio playback device 1 should not be particularly limited, well-known standards of the wireless LAN will be applied in this case. As current wireless LAN standards, IEEE802.11, IEEE802.11a, IEEE802.11b, IEEE802.11g, IEEE802.11j, IEEE802.11n and the like are put into practical use, settling or developing. In the embodiment, at least audio playback device 1 and the wireless LAN access point 3 mount the communication function supporting IEEE802.11g, and wireless data communication using the same channel according to IEEE802.11g are performed between the audio playback device 1 and the wireless LAN access point 3.

Next, referring to FIG. 2, a configuration example of the audio playback device 1 will be explained. As explained with reference to FIG. 1, the audio playback device 1 is portable, and plays back audio by receiving data of audio content files transmitted by the audio server device 2 connected to networks via the wireless LAN, as a main function. As explained later, a function of playing back audio by receiving radio broadcasting, a function of reading out audio signal data stored in a prescribed storage medium and plays back audio by including a playback function corresponding to the medium and the like are added.

Figure 2:
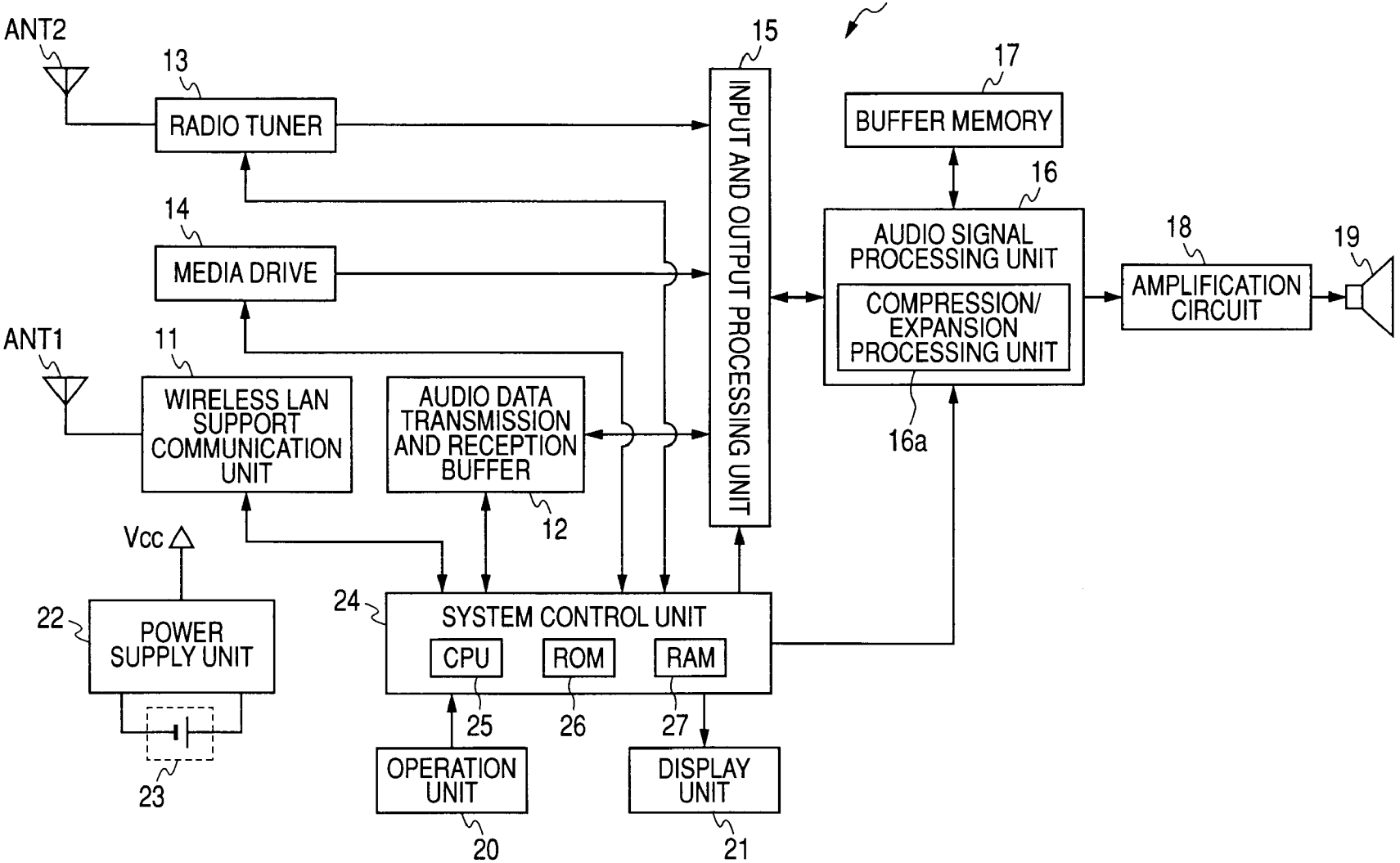
FIG. 2 is a block diagram showing a configuration example of the audio playback device according to the embodiment.

In FIG. 2, a wireless LAN support communication unit 11 is a unit including a combination of function units having hardware and software for executing transmission and reception, namely, data communication which supports prescribed wireless LAN standards (at least IEEE802.11g, in the embodiment), which mainly includes processing functions corresponding to a physical layer and a data link layer (MAC (a media access control) layer) in a network hierarchy. An internal configuration of the wireless LAN support unit 11 will be described later.

For example, in response to the reception of radio waves for wireless LAN communication by a wireless LAN support antenna ANT 1, a reception signal is inputted in the wireless LAN support communication unit 11. The wireless LAN support communication unit 11 executes demodulation processing corresponding to modulation processing at the time of transmission with respect to the inputted reception signal, acquiring, for example, packet data to give it to a processing function corresponding to an upper network layer, which is installed, for example, in a system control unit 24. In the embodiment, there is a case that audio signal data is received by the wireless LAN support communication unit 11 as described later. For example, when the wireless LAN support communication unit 11 receives packets storing audio signal data, the system control unit 24 transferred the audio signal data taken out from the packets to an audio data transmission and reception buffer 12 to be stored therein temporarily. The audio signal data stored in the audio data transmission and reception buffer 12 is continuously read out to be inputted to an input and output processing unit 15 as one of audio sources. The audio signal data transmitted via the network such as the wireless LAN is transmitted by being divided in units of packets, and the time continuity is not assured because there are possibilities that collisions or errors occur. Therefore, the time-series continuity of audio signal data to be inputted into the side of an audio signal processing unit 16 is maintained by temporarily storing the received and acquired audio signal data by the audio data transmission and reception buffer 12.

A radio tuner 13 inputs a reception signal obtained by receiving given radio broadcasting waves by a radio supporting antenna ANT2 and executes processing such as selecting a channel by tuning processing or demodulation processing according to the control by the system control unit 24 to obtain an audio signal as radio audio. The audio signal obtained as described above is inputted into the input and output processing unit 15 as one of audio sources. For example, radio broadcasting receivable by the radio tuner 13 is FM, AM or the like, an analog audio signal is obtained, however, the audio signal processing unit 16 in the later step executes processing in a digital signal step as signal processing for playing back audio. Therefore, an A/D converter is included in the input and output processing unit 15, and the audio signal of radio broadcasting inputted first in the analog signal format is converted into a digital audio signal of a prescribed format (audio signal data) by the A/D converter.

A media drive 14 in this case is a drive device configured to be able to, at least, playback (read out) data corresponding to storage media which can store audio signal data of the prescribed format. As actual examples of media drive 14, drives corresponding to optical disc media such as a CD (Compact Disc) and a DVD (Digital Versatile Disc) can be cited. Also, drives corresponding to media formed by semiconductor memories such as a flash memory can be applied. The audio signal data read out from the media by the media drive 14 is inputted into the input and output processing unit 15 as an audio source.

As described above, the audio signal received and acquired via the wireless LAN, the audio signal acquired by receiving the radio broadcasting and the audio signal acquired by being read out from media by the media drive 14 are inputted into the input and output processing unit 15 as audio signals of source audio to be played back. The input and output processing unit 15 selects one kind of audio signals to be played back from audio signals inputted as described above according to the control of the system control unit 24 to be outputted with respect to the audio signal processing unit 16.

The audio signal processing unit 16 executes playback signal processing of audio signal data inputted as the audio source to be played back as described above according to the type and format thereof. For example, in the case that audio compression and encoding are performed to the audio signal data to be inputted, expansion (decoding) processing corresponding to the compression and encoding is performed. In the embodiment, the audio signal data as the audio content file transmitted from the audio server device 2 is made to be a prescribed format which is compressed and encoded. As a method of the audio compressed and encoding is not particularly limited, well-known methods or methods which will be known or will be practically used in the future may be appropriately applied. In addition, demodulation processing according to a prescribed recording modulation (for example, run length limited modulation) performed to the inputted audio signal data and the like are executed. Moreover, signal processing for tone control and the like is performed. When performing such signal processing, necessary processing is allowed to proceed, while audio signal data to be processed is temporarily stored in a buffer memory 17 if necessary.

The audio signal received signal processing in the audio signal processing unit 16 is amplified in an amplification circuit 18 to drive, for example, a speaker 19. Accordingly, the audio signal received and acquired via the network (wireless LAN), the audio signal acquired by receiving and selecting a channel of radio broadcasting or the audio signal acquired by being played back from media is played back and outputted as audio from the speaker 19.

It is preferable that audio playback is configured to be performed by headphones, in addition to audio playback by the speaker 19, or instead of that. Generally, audio contents are formed by two-channel stereo of L (left) and R (right) or, for example, so-called multi-channel stereo represented by 5.1 ch surround and the like. The audio playback device 1 in the embodiment can also support playback of audio contents according to the given channel configuration in actual, however, in FIG. 2, an audio signal processing system is shown so as to integrate these plural-channel configuration for making explanation easy and comprehensive.

When data transmission is performed via the wireless LAN (network), a packet storing a payload is generated according to a prescribed communication protocol by control processing of the system control unit 24, and the packet is transmitted from the wireless LAN support antenna ANT1 as radio waves from the wireless LAN support communication unit. In the configuration of the audio playback device 1 in the embodiment, it is also possible to transmit and output audio signals via the wireless LAN, which have been acquired by receiving radio broadcasting by the radio tuner 13 or the audio signal acquired by being played back by the media drive 14, however, this will be described later.

The system control 24, for example, is configured based on a microcomputer including a CPU (Central Processing Unit)

25, a ROM 26, a RAM 27 and the like, executing various control processing in the audio playback device 1. The ROM 26 in this case stores programs to be executed by the CPU 25, set values, information and so on, which are used for various control processing by the CPU 25. The ROM 26 is formed as a storage device which can only perform ordinary readout, however, it is also preferable to apply, for example, a storage device formed by a nonvolatile memory such as a flash memory. When applying such nonvolatile memory, version-up and the like can be performed easily with respect to various data including programs, if necessary. The RAM 27 loads programs to be executed by the CPU 25 as well as used as a work area in the process that the CPU 25 executes processing.

An operation unit 20 in this case shows both various operation elements provided at the main body of the audio playback device 1 and an operation signal output unit which generates operation signals according to the operation performed with respect to the operation elements and outputs them to the control unit 24 (CPU 25). When the audio playback device 1 is configured to perform operation by a remote controller, the remote controller and a receiving unit which receives an operation code signal transmitted from the remote controller on the side of the main body and outputs the signal to the control unit 24 as an operation signal are also included in the operation unit 20. The display unit 21 is configured to include, for example, a display screen unit having a prescribed size provided in an expressive manner so that the user can see and recognize in the main body of the audio playback device 1, displaying various necessary contents according to the control by the system control unit 24. For example, in the audio playback device 1 in the embodiment, a list of audio content files stored and managed in the audio server device 3 and the like are displayed. In addition, a GUI (Graphical User Interface) image used for operation for selecting and playing back the audio content file and the like are displayed. When playing back the audio content file, playback time and the like in accordance with the playback progress are displayed. When the radio tuner 13 is in active use, receiving bands (FM, AM and the like) or receiving frequencies and the like are displayed according to the operation of the radio tuner. When the media drive 14 is in active use, display of a list of audio content files stored in the medium, display indicating playback progress during playback and the like are performed.

Since the audio playback device 1 of the embodiment is portable, it is possible to drive a battery as a power supply. According to the configuration, a battery 23 and a power supply unit 22 are shown in FIG. 2. The battery 23 is, for example, a charging battery, a dry-cell battery or the like, which supplies electric power of DC voltage to the power supply unit 22 in a state that the battery 23 is accommodated in a given accommodating position in the main body of the audio playback device 1. The power supply unit 22 is, for example, a DC/DC converter which converts DC voltage supplied from the battery 23 into DC power supply voltage Vcc of a prescribed value. The DC power supply voltage Vcc is supplied to, for example, circuit units actually configuring various function blocks shown in FIG. 2 as electric power. As a practical use of the audio playback device 1, it is also preferable that the device is configured to be operated by receiving DC voltage obtained from a commercial AC power supply by, for example, a power supply adaptor, instead of the battery 23, however, such configuration is not shown here.

Figure 3:
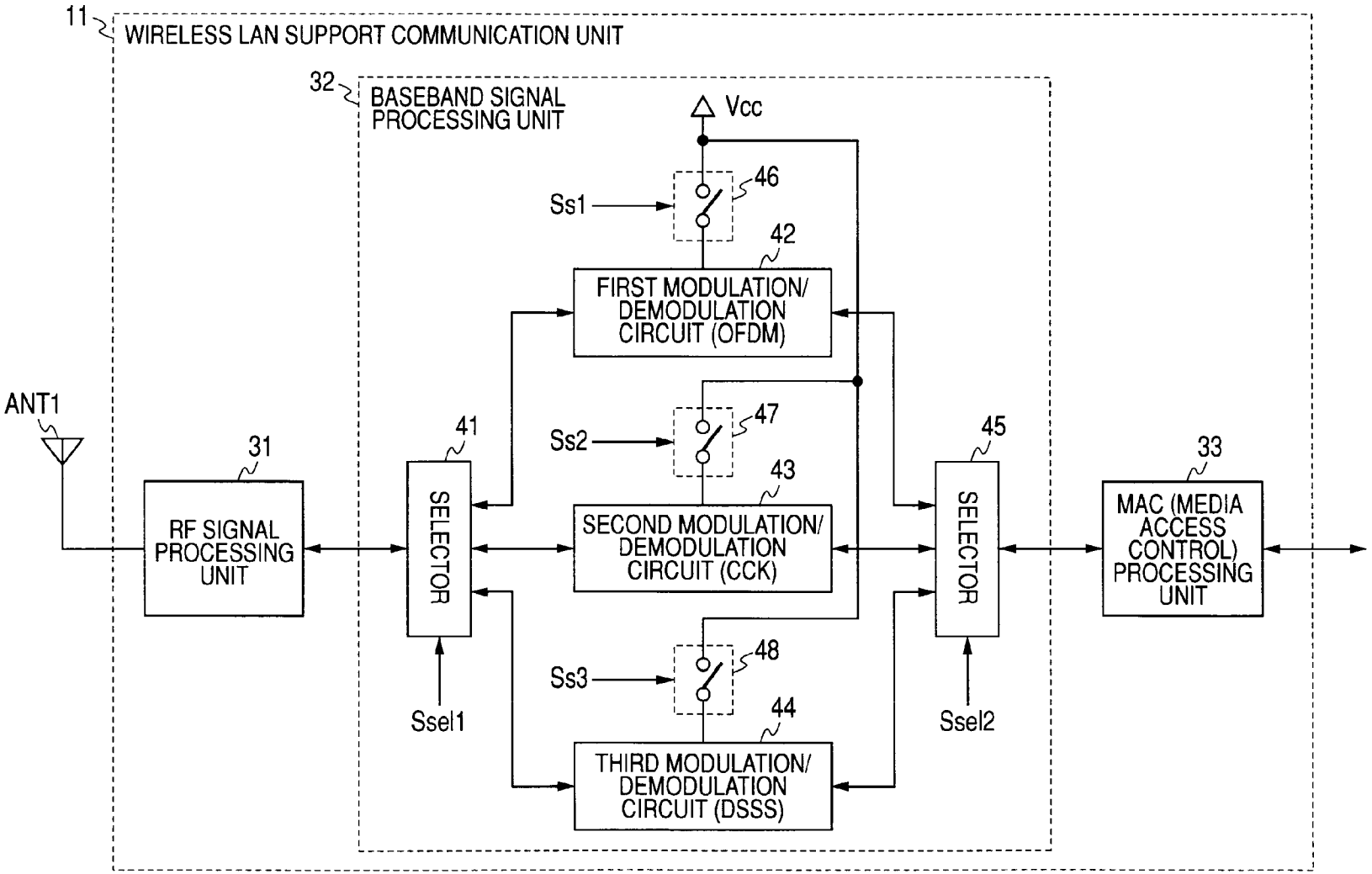
FIG. 3 is a block diagram showing a configuration example of a wireless LAN support communication unit in the audio playback device of the embodiment.

FIG. 3 shows an internal configuration example of the wireless LAN support communication unit 11 included in the audio playback device 1 shown in FIG. 2. As shown in the drawing, the wireless LAN support communication unit 11 includes, by and large, an RF signal processing unit 31, a baseband signal processing unit 32 and a MAC (Media Access Control) processing unit 33. A reception signal obtained by receiving communication radio waves transmitted by the wireless LAN through the antenna ANT2 is an RF (Radio Frequency) signal, which will be inputted in the RF signal processing unit 31. The RF signal processing unit 31 executes prescribed processing including amplification with respect to the inputted RF signal to be outputted to the baseband signal processing unit 32. The baseband signal processing unit 32 includes a later-described internal configuration, executing demodulation processing corresponding to digital carrier modulation performed to the inputted reception signal to obtain a baseband signal. Then, the baseband signal is outputted to the MAC processing unit 33. The MAC processing unit 33 executes signal processing and data processing for converting the inputted baseband signal into packet data corresponding to, for example, Ethernet (data link layer: MAC layer). The packet data obtained as described above is sent to an upper processing layer (system control unit 24).

When performing data transmission from the audio playback device 1 via the wireless LAN, a packet for transmission in which a command or data is stored in a payload is inputted into the MAC processing unit 33. The MAC processing unit 33 converts data, for example, as the inputted packet, into a baseband signal adapted to the set communication speed of the wireless LAN to output the signal to the baseband signal processing unit 32. The baseband signal processing unit 32 performs digital carrier modulation of a method adapted to the set communication speed by using the inputted baseband signal according a later-described configuration. Accordingly, a carrier signal, namely, an RF signal modulated by the signal of the transmission data is obtained. Then, transmission data is transmitted and outputted from the antenna ANT2 as communication radio waves by amplifying and outputting the RF signal.

Next, a configuration example of the baseband signal processing unit 32 will be explained. As described before, the audio playback device 1 of the embodiment supports IEEE802.11g as a wireless LAN standard. According to this, the baseband signal processing unit 32 includes a configuration supporting IEEE802.11g. Before explaining an internal configuration of the baseband signal processing unit 32 in FIG. 3, matters relating to baseband signal processing unit 32, which concerns IEEE802.11g, will be explained.

As is well known, IEEE802.11g is the wireless LAN standard in which a frequency band is 2.4 GH, a nominal communication speed (also called as transmission speed) is 54 Mbps, which has an upper layer compatibility with respect to IEEE802.11b (nominal communication speed: 11 Mbps/22 Mbps). IEEE802.11g has the nominal communication speed of 54 Mbps as described above, in which communication speeds lower than 54 Mbps are prescribed in stages with the communication speed 54 Mbps as the maximum, as shown in FIG. 4. An example of the prescribed contents is shown in FIG. 4. As shown in FIG. 4, communication speeds (prescribed communication speeds) prescribed in IEEE802.11g are twelve stages of 54 Mbps, 48 Mbps, 36 Mbps, 24 Mbps, 18 Mbps, 12 Mbps, 9 Mbps, 6 Mbps, 11 Mbps, 5.5 Mbps, 2 Mbps, and 1 Mbps. As is well known, in equipment performing wireless LAN communication by actual IEEE802.11g, communication by the prescribed communication speed which is regarded as the maximum speed is performed, in these prescribed communication speeds whose error occurrence rates are less than a fixed rate, accordingly, setting change of the prescribed communication speed is dynamically performed at the time of communication.

In FIG. 4, digital carrier modulation methods corresponding to each prescribed communication speed of twelve stages are shown. As shown in FIG. 4, when the prescribed communication speed is 54 Mbps, 48 Mbps, 36 Mbps, 24 Mbps, 18 Mbps, 12 Mbps, 9 Mbps, or 6 Mbps, OFDM (Orthogonal Frequency Division Multiplexing) corresponds, when the communication speed is 11 Mbps or 5.5 Mbps, CCK (Completely Code Keying) corresponds, and when the communication speed is 2 Mbps or 1 Mbps, DSSS (Direct Sequence Spread Spectrum) corresponds, respectively as the carrier modulation methods. In the transmission and reception according to the wireless LAN, digital carrier modulation/demodulation is accompanied as described until now, however, the carrier demodulation methods corresponding to the prescribed communication speeds of twelve stages as IEEE802.11g are not unified, and there are three methods as described above. Respective prescribed communication speeds of twelve stages correspond to any of these three methods. Since the three carrier modulation methods are well known, the explanation about these methods is omitted here.

Based on the explanation according to FIG. 4, an internal configuration of the baseband signal processing unit 32 shown in FIG. 3 will be explained. The baseband signal processing unit 32 shown in the drawing includes a selector 41, a first modulation/demodulation circuit 42, a second modulation/demodulation circuit 43, a third modulation/demodulation circuit 44, a selector 45, switches 46, 47 and 48. In these function blocks, first, the first modulation/demodulation circuit 42 is configured to execute modulation processing and demodulation processing corresponding to OFDM. The second modulation/demodulation circuit 43 executes modulation processing and demodulation processing corresponding to CCK and the third modulation/demodulation circuit 44 executes modulation processing and demodulation processing corresponding to DSSS.

As described before with reference to FIG. 2, respective circuit units in the audio playback device 1 are operated by receiving supply of the DC power supply voltage Vcc supplied from the power supply unit 22, however, in the drawing, lines for supplying the DC power supply voltage Vcc to the first modulation/demodulation circuit 42, the second modulation/demodulation circuit 43 and the third modulation/demodulation circuit 44 respectively are clearly expressed for showing the significance of the switches 46, 47 and 48. As shown in the drawing, the switch 46 is inserted in the line supplying the DC power supply voltage Vcc with respect to the first modulation/demodulation circuit 42. Therefore, in the state that the switch 46 is turned on, the first modulation/demodulation circuit 42 can operate by receiving supply of the DC power supply voltage Vcc. Whereas in the state that the switch 46 is turned off, the power is not supplied to the first modulation/demodulation circuit 42 and the circuit stops the operation. Similarly, the switches 47, 48 are respectively inserted in lines supplying the DC power supply voltage Vcc with respect to the second modulation/demodulation circuit 43 and the third modulation/demodulation circuit 44, and the second modulation/demodulation circuit 43 and the third modulation/demodulation circuit 44 are switched between the available state and unavailable state according to the on/off state of these switches 47, 48. The on/off state of the switches 46, 47 and 48 is switches by switch on/off control signals Ss1, Ss2 and Ss3 outputted from the system control unit 24 (CPU 25), respectively. These switch on/off control signals Ss1, Ss2 and Ss3 are not interlocked, and outputted independently. Therefore, on/off of power supply with respect to the first modulation/demodulation circuit 42, the second modulation/demodulation circuit 43, and the third modulation/demodulation circuit 44 can be controlled individually.

The selector 41, at the time of reception, receives a reception signal (RF signal) outputted from the RF signal processing unit 31 and outputs the signal to any one of demodulation circuits of the first modulation/demodulation circuit 42, the second modulation/demodulation circuit 43, and the third modulation/demodulation circuit 44 to select the path. At the time of transmission, the selector 41 selects one of the modulation outputs of the first modulation/demodulation circuit 42, the second modulation/demodulation circuit 43, and the third modulation/demodulation circuit 44, and outputs it to the RF signal processing unit 31. The selector 45, at the time of reception, selects one of demodulation outputs of the first modulation/demodulation circuit 42, the second modulation/demodulation circuit 43, and the third modulation/demodulation circuit 44, and outputs it to the MAC processing unit 33. At the time of transmission, the selector 45 receives the output signal from the MAC processing unit 33 and output it to any one of demodulation circuits of the first modulation/demodulation circuit 42, the second modulation/demodulation circuit 43, and the third modulation/demodulation circuit 44. The selection of the path in the selectors 41, 45 is controlled by selector control signals Ssel1, Ssel2 outputted by the system control unit 24 (CPU 25). For confirmation, the control of the path selection is performed by allowing the modulation/demodulation circuit selected by the selectors 41, 45 to be the same so that the signal is appropriately inputted to and outputted from the baseband signal processing unit 32 for the interlocked operation. For example, when the first modulation/demodulation circuit 42 is selected on the side of the selector 41, the first modulation/demodulation circuit 42 is selected also on the side of the selector 45.

For example, prescribed communication speed setting is any of 54 Mbps, 48 Mbps, 36 Mbps, 24 Mbps, 18 Mbps, 12 Mbps, 9 Mbps, or 6 Mbps, it correspond to OFDM as the carrier modulation method according to FIG. 4. Therefore, the system control unit 24 outputs the selector control signals Ssel 1, Ssel2 so that the selectors 41, 45 select the first modulation/demodulation circuit 42 as a signal transmission path. When setting switching of prescribed communication speed is performed from the above state to the prescribed communication speed of either 11 Mbps or 5.5 Mbps, the carrier modulation method will be CCK, therefore, the system control unit 24 outputs the selector control signals Ssel1, Ssel2 so that the selectors 41, 45 select the path to the second modulation/demodulation circuit 43. Further, when setting switching of the prescribed communication speed is performed from the above state to the prescribed communication speed of either 2 Mbps or 1 Mbps, the carrier modulation speed will be DSSS. Then, the system control unit 24 outputs the selector control signals Ssel1, Ssel2 so that the selectors 41, 45 select the path to the third modulation/demodulation circuit 44.

The audio playback device 1 of the embodiment according to the configuration described above receives data of audio content files (audio signal data) transmitted from the audio server device 2 via the wireless LAN to playback audio. Concerning a bit rate of actual audio signal data, it is approximately 1.4 Mbps even in the case of a digital audio signal, for example, whose sampling frequency is 44.1 kHz, and whose quantifying bit number is 16-bit which corresponds to a CD format. In addition, the bit rate of audio signal data in an audio compressed and encoded form such as audio content files transmitted from the audio server device 2 becomes low to approximately 1/10 of the above digital audio signal. Considering the above, IEEE802.11g the maximum prescribed communication speed of which is 54 Mbps even at present has too sufficient ability with respect to data transmission of audio signal data. As specifications of a common wireless LAN adaptor, data communication is performed with the maximum prescribed communication speed being set in prescribed communication speeds in which sufficient communication stability with the error rate of less than a fixed rate during communication as described above. Concerning this point, types of data to be transmitted do not matter.

Concerning the relation between the prescribed communication speed and electric power, it is known that necessary electric power varies according to the prescribed communication speed. Generally, for example, in the same carrier modulation method, necessary electric power increases as the prescribed communication speed becomes high.

Figure 5:
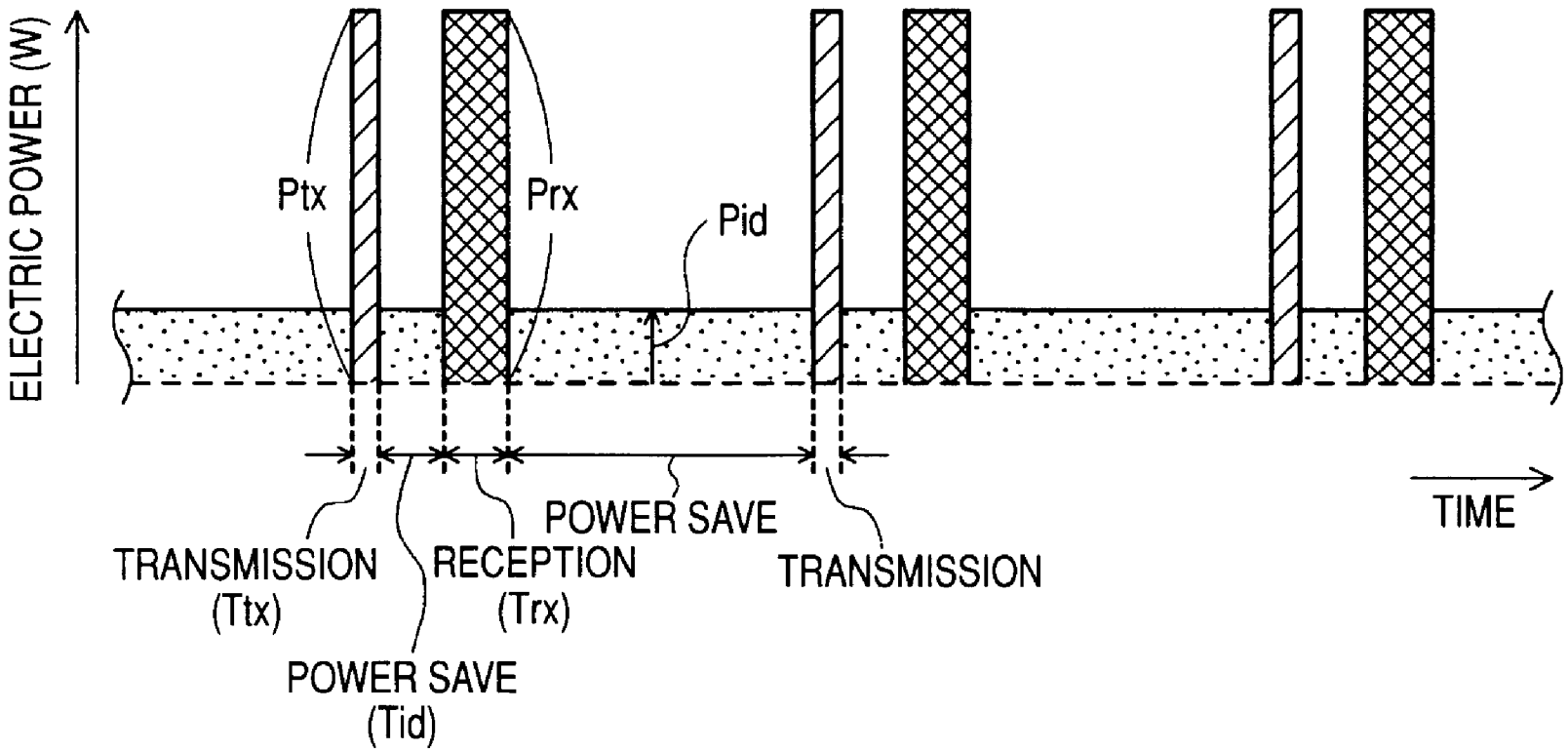
FIG. 5 is a view for explaining a basic calculation method of a power consumption amount in wireless LAN communication.

A power consumption amount according to communication operation as the wireless LAN can be calculated in a manner shown in FIG. 5 in the basic concept. In the drawing, a situation example in which transmission and reception of data is intermittently performed along the lapse of time under a condition that a certain prescribed communication speed is set. A period when neither of transmission operation nor reception operation is operated is an operation state of waiting in which electric power is restricted to less than a fixed value, called as "power save". In the drawing, time during which transmission operation is performed (transmission time) is denoted by Ttx, time during which reception operation is performed (reception time) is denoted by Trx, and time of power save (power save time) is denoted by Tlid. The vertical axis in the drawing indicates electric power, and electric power at the time of transmission is denoted by Ptx, electric power at the time of reception is denoted by Prx, and electric power at the time of power save is denoted by Pid. Therefore, for example, a power consumption amount (Pc) per unit time generated according to the communication operation by the wireless LAN can be found in a manner as follows. First, the total of transmission time per unit time Ttx, the total of reception time Trx and the total of power save time Tid are acquired. In that state, the power consumption amount (Pc) can be expressed by the following formula 1 by utilizing values of electric power at the time of transmission Ptx, electric power at the time of reception Prx and electric power at the time of power save time Pid, which are determined corresponding to the prescribed communication speed set at that time.

$$Pc=(Ttx*Ptx)+(Trx*Prx)+(Tid*Pid) \quad \text{(Formula 1)}$$

As described before, the necessary electric power varies depending on the prescribed communication speed. In the correspondence with FIG. 5, at least specific values of the electric power at the time of transmission Ptx and the electric power at the time of reception Prx vary depending on the prescribed communication speed. There is a possibility that the electric power Pid at the time of power save also varies depending on the prescribed communication speed according to the hardware configuration and the like. In addition, the transmission time Ttx and the reception time Trx under the condition of the same data transmission amount are shortened respectively in accordance of the increase of the prescribed communication speed. Therefore, the power consumption amount Pc represented by the formula 1 also varies according to the variation of prescribed communication speed. As parameter variation according to setting change of the prescribed communication speed, the electric powers Ptx, Prx at the time of transmission and reception are larger and more dominant than the transmission and reception times (Ttx, Trx). The electric powers Ptx, Prx tends to increase as the prescribed communication speed becomes high. Accordingly, the power consumption amount Pc tends to increase as the prescribed communication speed becomes high.

According to the precedent explanation, there have been a lot of cases that prescribed communication speed which is much larger than the bit rate of audio signal data is set when transmitting audio signal data by the current wireless LAN communication. For example, the case in which prescribed communication speed 36 Mbps is set when the bit rate of audio signal data is 1 Mbps or less can be cited. It is conceivable that such operation in the setting of prescribed communication speed until now is generally in state that electric power is consumed wastefully because excessively high prescribed communication speed is set, considering that stable transmission can be performed even in a lower prescribed communication speed concerning the transmission of audio signal data and that the power consumption amount tend to increase as the prescribed communication speed becomes high as described above. The audio playback apparatus 1 of the embodiment adopts the configuration in which battery driving is possible as described with reference to FIG. 1. Therefore, the longest possible battery lifetime is necessary. Then, since the wasteful power consumption as described above is a factor making the battery lifetime short, it is necessary to eliminate the factor.

The audio playback device 1 of the embodiment, roughly speaking, aims to reduce the power consumption effectively as compared with related arts, while securing good reception state of audio signal data by performing the following setting of prescribed communication speed at the time of receiving audio signal data.

Specifically, first, in the state that the audio playback device 1 receives data of an audio content file (audio signal data) transmitted from the audio server device 2, the audio playback device 1 recognizes a bit rate concerning the audio content file receiving at present. A method of acquiring information indicating the bit rate on the side of the audio playback device 1 will be described later. Next, the audio playback device 1 finds the prescribed communication speed which is minimally necessary for transmitting audio signal data receiving at present based on the recognized bit rate. That is, the audio playback device 1 finds the minimum speed from prescribed communication speeds at which stable transmission is assured with respect to the audio signal data having the recognized bit rate. As the prescribed communication speed regarded as minimally necessary, the minimum speed may be selected from prescribed communication speeds of values exceeding the recognized bit rate in a simple manner. However, in actual communication, it is necessary to consider the reduction of throughput due to existence of another device which is performing wireless LAN communication using the same channel or the increase of retry due to temporary interference. Accordingly, in actual, considering the above, the prescribed communication speed which is minimally necessary is set while securing a fixed margin.

After finding the prescribed communication speed regarded as minimally necessary is found as described above, next, a speed at which necessary electric power at the time of transmission and reception (and at the time of power save) is minimum is selected from prescribed communication speeds higher than the minimally necessary prescribed communication speed including the minimally necessary speed as the optimum prescribed communication speed. As explained before, electric power necessary at the time of transmission and reception (and at the time of power save) tends to decrease as the prescribed communication speed reduces. From this point of view, the prescribed communication speed regarded as minimally necessary can be found as the optimum prescribed communication speed as it is. It is possible to apply such algorithm in the embodiment of the invention. However, it is conceivable that the power consumption is not always decrease as the prescribed communication speed becomes slow, depending on the hardware configuration for the wireless LAN communication, operation conditions according to actual prescribed communication speeds and the like. According to the embodiment, as shown in FIG. 4, there are three modulation methods with respect to the prescribed communication speed of twelve stages. There may be a possibility that the difference of electric power due to the difference of modulation methods incurs the above situation. Accordingly, in the embodiment, the prescribed communication speed regarded as minimally necessary is not simply taken as the optimum prescribed communication speed, but a speed at which necessary electric power is actually minimum is selected from prescribed communication speeds which are higher than the prescribed communication speed regarded as minimally necessary as described above. A procedure and a configuration example for that will be described later.

After the optimum prescribed communication speed has been selected as described above, the audio playback device 1 executes communication control so that communication by the wireless LAN in the optimum prescribed communication speed is performed. In the correspondence with respect to FIG. 1, the control is performed so that the wireless LAN communication in which the optimum prescribed communication speed is set is performed between the audio playback device 1 and the wireless LAN access point 3. The communication in the optimum prescribed communication speed is performed in this manner, accordingly, the audio playback device 1 of the embodiment executes the wireless LAN communication by lesser electric power than related arts. That is, the power consumption amount is reduced as compared with the power consumption amount before switched to the optimum prescribed communication speed. A specific example concerning a method of switching communication between the audio playback device 1 and the wireless LAN access point 3 so as to be an operation mode by the optimum prescribed communication speed will be also described later.

In the state that the communication by the optimum prescribed communication speed is established as described above, in the baseband signal processing unit 32 in the wireless LAN support communication unit 11, processing of carrier demodulation is executed by a modulation/demodulation circuit of a carrier modulation method to which the optimum prescribed communication speed correspond. For example, the optimum prescribed communication speed is 12 Mbps, the carrier modulation method corresponding to this is OFDM, therefore, the first modulation/demodulation circuit 42 in the baseband processing unit 32 executes carrier demodulation processing. Seeing this from the other perspective, the remaining second modulation/demodulation circuit 43 and the third modulation/demodulation circuit 44 do not execute particularly effective processing. However, for example, in related arts, the DC power supply voltage Vcc is supplied to the whole portion as the baseband signal processing unit 32, therefore, the DC power supply voltage Vcc is usually supplied to all modulation/demodulation circuits. In that state, the DC power supply voltage Vcc is regularly supplied to modulation/demodulation circuits not executing effective processing, therefore, wasteful power is consumed in these circuit units.

In the embodiment, as shown in FIG. 3, the switches 46, 47 and 48 are provided to allow the first modulation/demodulation circuit 42, the second modulation/demodulation circuit 43, and the third modulation/demodulation circuit 44 to switch on/off independently the supply of DC power supply voltage Vcc with respect to respective circuits, and switches corresponding to two modulation/demodulation circuits which are not in execution of effective processing can be switched to the off-state. Accordingly, the supply of the DC power supply voltage Vcc with respect to the modulation/demodulation circuits which are not necessary to execute effective processing is stopped, as a result, electric power is not consumed in these modulation/demodulation circuits. Accordingly, in the embodiment, first, communication is performed by setting the prescribed communication speed (optimum communication speed) which is sufficient for good transmission of audio signal data as well as whose necessary electric power is minimum, secondly, the power supply to the carrier modulation/demodulation circuit systems other than the system used corresponding to the set optimum communication speed is stopped, thereby reducing power consumption effectively at the time of transmitting data of audio content files (audio signal data) by the wireless LAN communication.

An example of a technical configuration for realizing operation for reducing the power consumption amount will be explained below. First, in the audio playback device 1 of the embodiment, table information (communication speed correspondence characteristic table) of a configuration example shown in FIG. 6 is stored in advance for the operation of reducing the power consumption amount. As a storage area in which the communication speed correspondence characteristic table is stored, for example, a partial storage area of the ROM 26 in the system control unit 24 can be used. The communication speed correspondence characteristic table shown in FIG. 6 has a configuration in which values of respective items of electric power at the time of transmission, electric power at the time of reception, standard communication time and retry occurrence probability are associated according to twelve prescribed communication speeds which can be set under IEEE802.11g also shown in FIG. 4. The electric power at the time of transmission indicates electric power at portions operating in association with the communication including the wireless LAN support communication unit 11 and the like which is a load when data transmission is executed, as communication operation according to the corresponding prescribed communication speed. The electric power at the time of reception indicates electric power at portions operating in association with the communication including the wireless LAN support communication unit 11 and the like which is a load when data reception is executed, as communication operation according to the corresponding prescribed communication speed. The standard communication time indicates a standard value as time length necessary for communication in the case that a certain unit of data is transmitted (transmission and reception) according to the corresponding prescribed communication speed. The standard communication time indicates time length when the unit amount of data is continuously transmitted excluding waiting time due to collisions, probability of retry due to a transmission error and the like. The standard communication time can be found, for example, based on the size of unit data to be transmitted and the prescribed communication speed value as the simplest method. The standard communication time can be indicated by a magnification value based on a given prescribed communication speed taken as a reference (for example, "1" as a numeric value) not indicated by an actual value. The retry occurrence probability indicates values of occurrence probability of retry in unit time (namely, a transmission error) in the case that communication is performed by the corresponding prescribed communication speed. It is known that the stability of the wireless LAN communication is not fixed with respect to variation of the communication speed, and has tendency to be reduced as the communication speed becomes high. Therefore, the retry occurrence probability varies according to the prescribed communication speed, and in this table, the retry occurrence probabilities corresponding to each prescribed communication speed are shown. In FIG. 6, columns of the respective items corresponding to each prescribed communication speed are shown by blanks, however, given values are stored in actual.

Values of respective items of the electric power at the time of transmission, electric power at the time of reception, the standard communication time and the retry occurrence probability may be found based on, for example, results of examination performed in advance. In addition, it is also preferable that values of respective items is rewritten or updated according to the operation state when communication is actually performed. According to this, item values which are more precise than values actually being applied.

Next, a procedure example executed by the audio playback device 1 for the reduction operation of power consumption amount in the embodiment will be explained with reference to flowcharts in FIG. 7 to FIG. 9. The procedures shown in these drawings are regarded as processing operation realized by executing programs stored in the ROM 26 by the CPU 25 in the system control unit 24. Such programs can be stored by being written in, for example, the ROM at the time of manufacture and the like, or stored in a removal storage medium, then, stored in a prescribed rewritable storage device or storage medium included in the audio playback device 1 by being installed from the storage medium. It is also conceivable that programs are stored in a storage device in a server and the like on the network, then, acquired by being downloaded from the server using a network communication function (wireless LAN function, in this case) of the audio playback device 1 to be installed in a prescribed storage device or storage medium.

Figure 7:
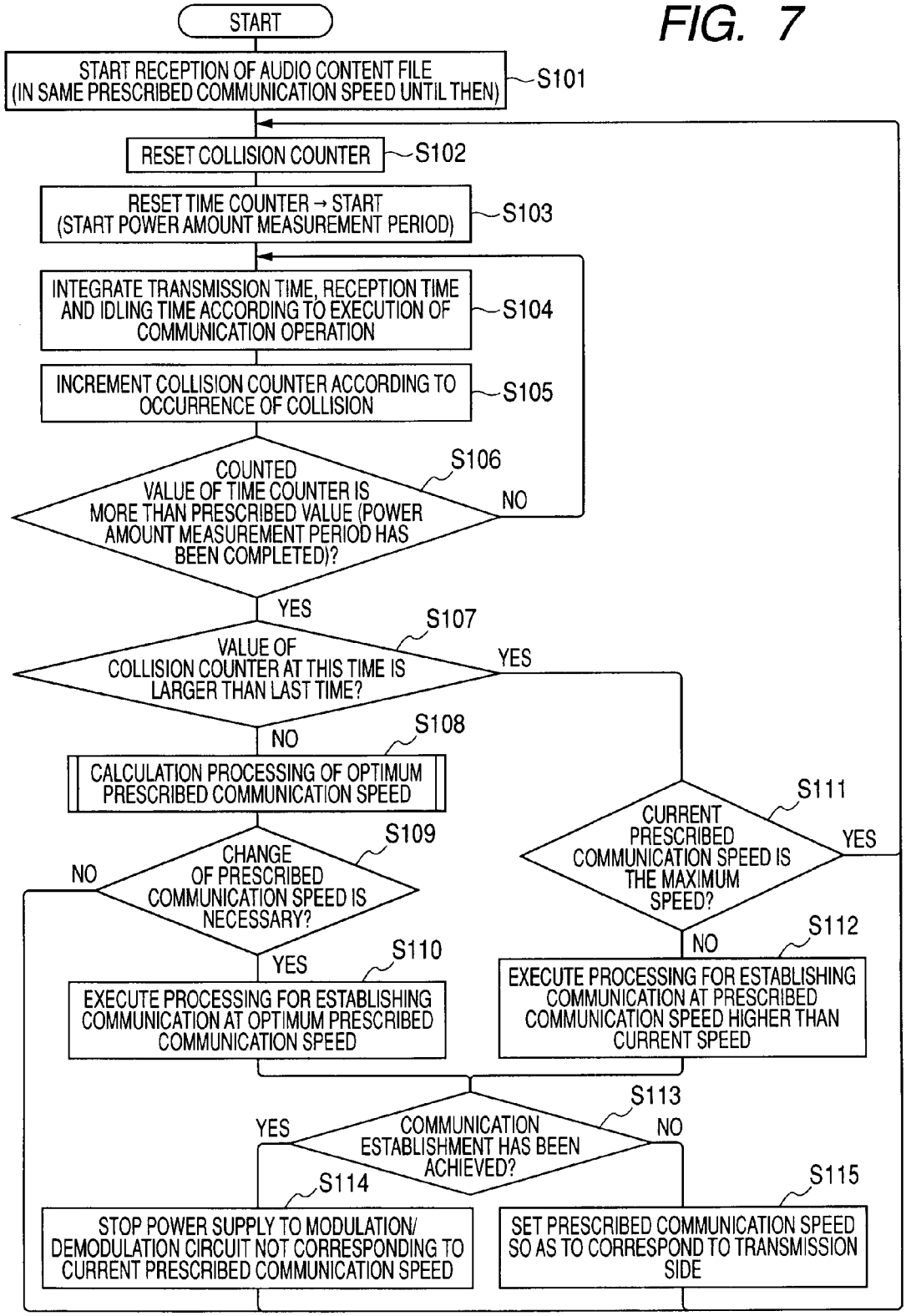
FIG. 7 is a flowchart showing a processing procedure example executed by the audio playback device (system control unit, CPU) for reducing the power consumption amount of the embodiment.

In FIG. 7, first, in response to transmission of data of an audio content file (audio signal data) whose transmission destination is designated as at least the audio playback device 1 of itself from the audio server unit 2 via the network (wireless LAN), control processing for receiving the audio signal data is started in Step S101.

Concerning Step S101, a procedure example until the audio playback device 1 requests the audio content file to the audio server device 2 is explained briefly. For example, the audio playback device 1 and the audio server device 2 recognize that they are devices which can perform transmission and reception of audio content files to and from each other, which makes the same audio listening system, by communication processing supporting a prescribed protocol (for example, SSDP (Simple Service Discovery Protocol) and the like can be cited), which is performed in advance, for example, at the time of activation. That is, the audio playback device 1 recognizes that the audio server device 2 is the server storing and providing audio content files, and the audio server device 2 recognizes that the audio playback device 1 is a player, a client which is capable of playing back audio content files. Under such condition, the audio playback device 1 request list information of the audio content files to the audio server device 2 according to the operation for displaying the list of audio content files, which is performed, for example, with respect to the operation unit 20. In response to the request, the audio server device 2 transmits list information concerning the audio content files stored and managed by itself to the audio playback device 1 as the request source. In the case of the embodiment, the list information includes, first, the list contents of all stored audio content files, or part of audio content files stored in directories, or the list contents of audio content files managed by the classification according to artists, categories and the like. The contents corresponding to each audio content file forming the list includes a URL (Uniform Resource Locator) indicating a location of the audio content file, a title of the file and the like, and in the embodiment, also includes information of a bit rate of each audio content file. For confirmation, audio content file data transmitted by the audio listening system of the embodiment is compressed audio signal data to which audio compression and encoding of a prescribed method is performed, in which the bit rate of each audio content file varies according to, for example, the compression ratio set at the time of compression and encoding. The audio playback device 1, when receiving list information of audio content files as described above, for example, allows the display unit 21 to display the list of audio content files by using the list information. At this time, at least titles are displayed in order to clearly indicate, for example, the contents of audio content files. The user can grasp what kinds of audio content files are stored in the audio server device 2 by seeing the display.

Suppose that the user selects an audio content file which is desired to be played back by the audio playback device 1 from the list of audio content files displayed as the above and performs operation for instructing playback. In response to the operation, the audio playback device 1 requests the audio content file with respect to the audio server device 2 in accordance with a prescribed protocol. For example, it is conceivable to take a procedure in which the audio content file is requested by designating the URL thereof, using a HTTP (HyperText Transport Protocol) and the like. In response to the request, the audio server device 2 reads out data of the requested audio content file in audio content files stored in, for example the HDD and transmits and outputs the data to the audio playback device 1 as the request source. The procedure in Step S101 described before is to start the procedure for receiving and acquiring data of the audio content file transmitted from the audio server device 2 in the manner as described above. Through not shown in FIG. 7, after the reception and acquisition of data of the audio content file is started in Step S101, playback signal processing of audio signal data as the audio content file is also started as described with reference to FIG. 2, and audio playback is also started from, for example, the speaker 19. In the step when transmission of the audio content file data is started corresponding to Step S101 as described above, communication at the prescribed communication speed taken over from the speed before the start of the transmission of the audio content file is performed, which is set by the ordinary algorithm.

After starting the reception of the audio content file as described above, the system control unit 24 (CPU 25) resets a collision counter in Step S102 as well as resets time counter in the next step S103 to start the clocking (counting) operation. The collision counter is a counter counting the number of occurrence of collisions as understood from the above explanation. The time counter is a counter for clocking a time length Tp set as a power amount measurement period. Therefore, the power amount measurement period is started at the timing of Step S103 when the reset and start of the time counter are performed.

In Step S104, time (Ttx) taken for transmission operation as the wireless LAN communication, time (Trx) taken for reception operation and power save time (Tid) generated between the transmission operation and the reception operation, which have been executed according to time elapse in the power amount measuring period, are integrated respectively. For confirmation, the transmission integrated time and reception integrated time include operation time of retry in which transmission or reception of data which is the same as last time is performed. In parallel with this process, as shown in Step S105, processing of incrementing the collision counter according to the detection of collisions is also executed. The processing in Step S104 and S105 is repeated until it is determined that a counted value of the time counter is more than a given value corresponding to the set time length Tp as the power amount measurement period in Step S106. In Step S106, when it is determined that the power amount measurement period is completed, the process proceeds to a procedure after Step S107.

In Step S107, whether a counted value of the collision counter in this power amount measurement period (communication in the prescribed communication speed set at this time) is larger than a counted value of the collision counter in last power measurement period of last time (communication in the prescribed communication speed set at last time) or not is determined. That is, whether occurrence frequency, namely, incidence of collisions is increased or not as a tendency is determined. The increase of collisions means that the prescribed communication speed set at that time is low speed and occupation rate of communication time on the network is higher than necessary.

Then, when a negative determination result is obtained in Step S107, there is a possibility that a slower stage in the prescribed communication speeds can be set. As has been described above, generally, the power consumption is reduced as the prescribed communication speed becomes low. Therefore, after Step S108, the optimum prescribed communication speed is found, then, control for establishing wireless LAN communication at the optimum prescribed communication speed is executed.

In Step S108, processing for calculating and finding the optimum prescribed communication speed is executed. A procedure example as the calculation processing of the optimum prescribed communication speed in Step S108 is shown in FIG. 8.

Figure 8:
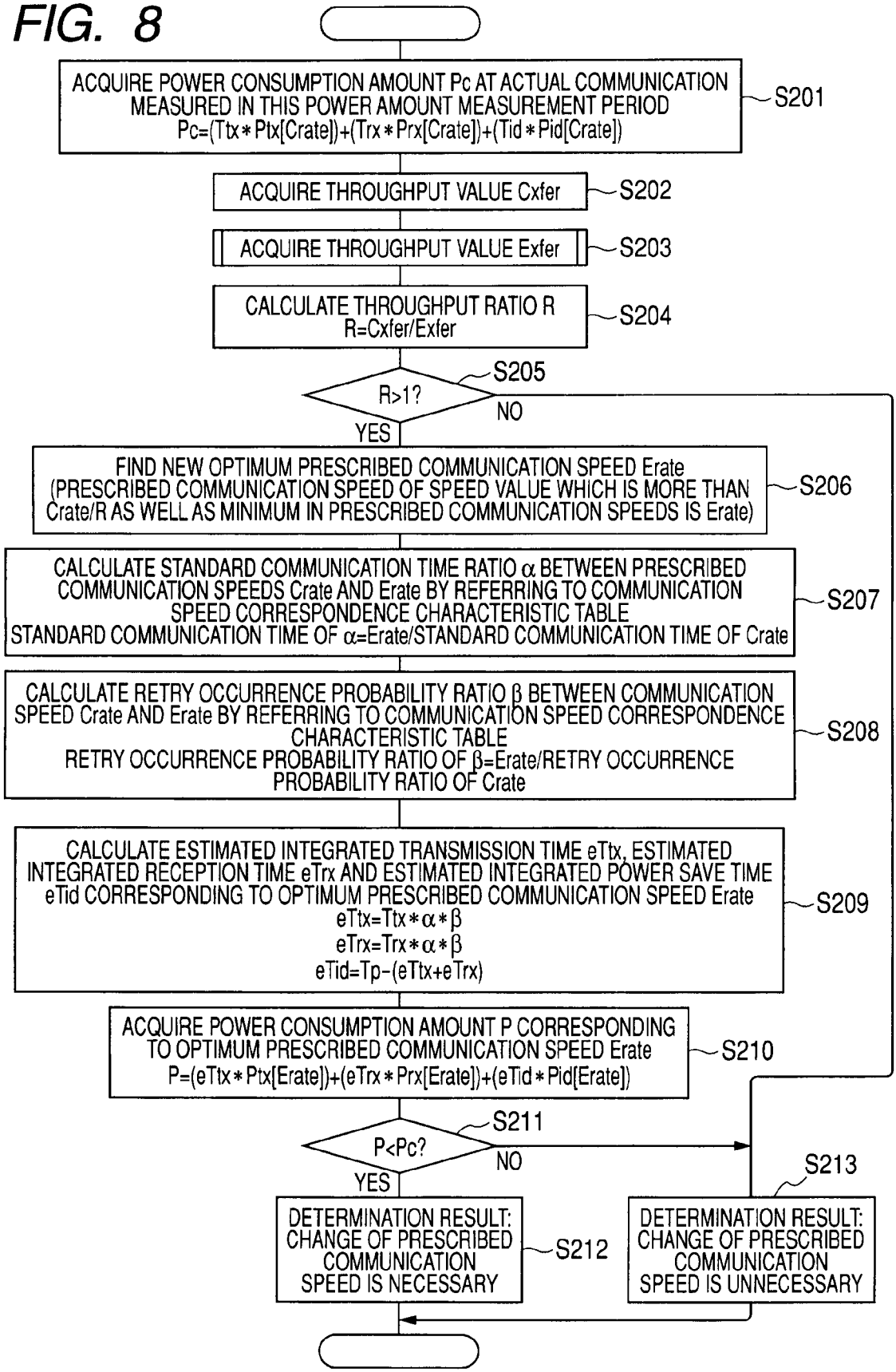
FIG. 8 is a flowchart showing a processing procedure example for calculating an optimum prescribed communication speed.
Figure 9:
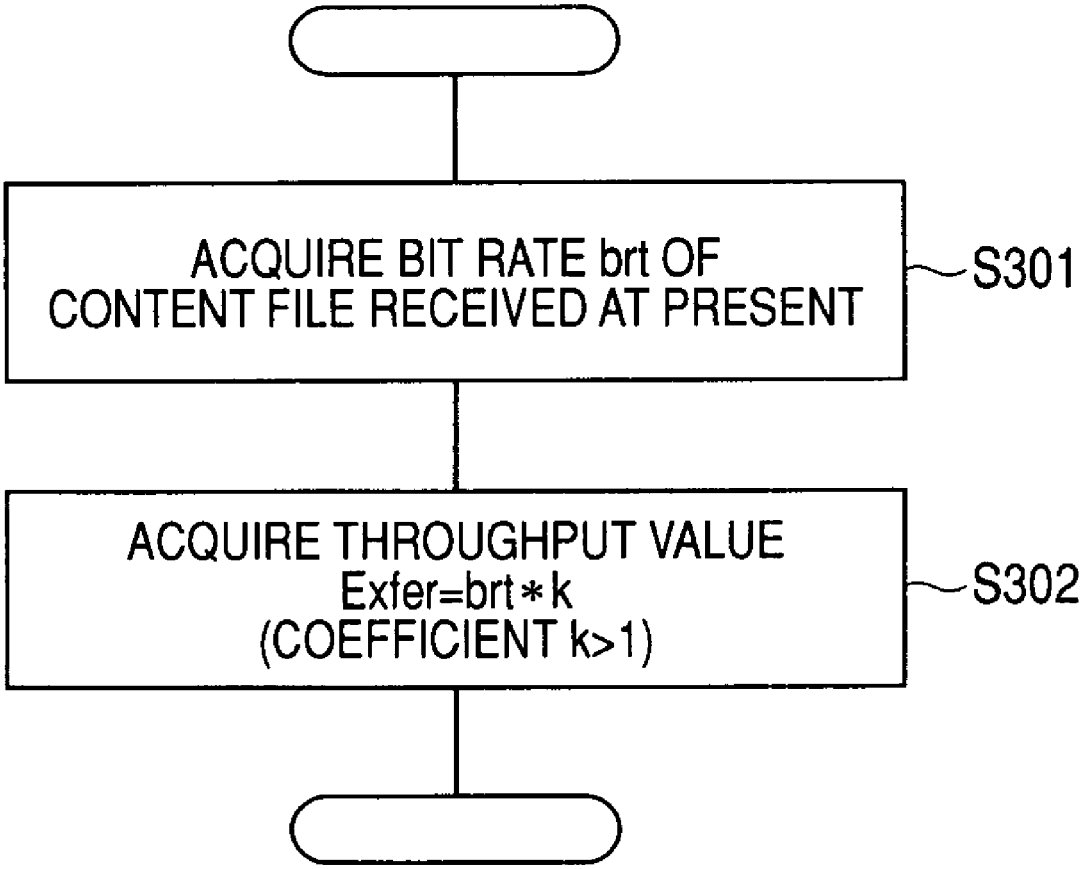
FIG. 9 is a flowchart showing a processing procedure example for acquiring a throughput value Exfer.

First, before explaining the procedure shown in FIG. 8, parameters used for the calculation processing of the optimum prescribed communication speed are shown. Ttx: integration value of transmission time in the power amount measurement period at this time, Trx: integrated value of reception time in the power amount measurement period at this time, Tid: integrated value of power save time in the power amount measurement period at this time, Ptx [Crate]: electric power at the time of transmission at the prescribed maximum speed set in the power amount measurement period at this time, Prx [Crate]: electric power at the time of reception at the prescribed maximum speed set in the power amount measurement period at this time, Pid [Crate]: electric power at the time of power save at the prescribed maximum speed set in the power amount measurement period at this time, Cxfer: current throughput value (effective communication speed), Exfer: throughput value minimally necessary corresponding to a bit rate of audio signal data transmitted at present, Crate: prescribed communication speed set at present, Erate: new optimum prescribed communication speed, eTtx: integrated value of transmission time in the power amount measurement period, which is estimated when communication is performed by new optimum prescribed communication speed, eTrx: integrated value of reception time in the power amount measurement period, which is estimated when communication is performed by new optimum prescribed communication speed, eTid: integrated value of power save time in the power amount measurement period, which is estimated when communication is performed by new optimum prescribed communication speed, Ptx [Erate]: electric power at the time of transmission which is estimated when communication is performed by new optimum prescribed communication speed, Prx [Erate]: electric power at the time of reception which is estimated when communication is performed by new optimum prescribed communication speed, Pid [Erate]: electric power at the time of power save which is estimated when communication is performed by new optimum prescribed communication speed.

In the procedure in FIG. 8, first, in Step S201, a power consumption amount Pc generated according to the result of the actual communication operation in the power amount measurement period at this time is found. In order to find this, for example, calculation represented by the following formula 2 is performed.

$$Pc=(Ttx*Ptx[\text{Crate}])+(Trx*Prx[\text{Crate}])+(Tid*Pid[\text{Crate}]) \quad \text{(Formula 2)}$$

The formula 2 can be regarded as a formula in which parameter definition of the precedent formula 1 is changed so as to find the power consumption amount Pc obtained in the power measurement period at this time in the processing of FIG. 7.

Subsequently, in Step S202, a current throughput value Cxfer is obtained. The throughput value in this case indicates effective communication speed actually obtained in the data transmission of the audio content file. The throughput value Cxfer can be found based on the data size of the audio content file per unit time received and acquired in the wireless LAN support communication unit 11, which is detected by, for example, the CPU 25.

In Step S203, a throughput value Exfer (effective communication speed) which is minimally necessary corresponding to the bit rate of the audio content file data transmitted at present (during reception) is calculated. The throughput value Exfer can be found in a manner as shown in FIG. 9. Specifically, first, as shown in Step S301, a bit rate "brt" of the audio content file received at present is acquired. As described before, in the step when the audio playback device 1 receives and acquires audio content file data, the audio playback device 1 already has list information of audio content files including information about the audio content file. The list information includes information indicating bit rates of respective audio content files. In Step 301, it is preferable to refer to the bit rate information included in the list information. The bit rate "brt" is also estimated from progress speed of an address for reading out data in the audio data transmission and reception buffer 12. As described before, the received and acquired audio signal data is stored in the audio data transmission and reception buffer 12 once, and readout is performed corresponding to a pace of signal processing in the audio signal processing unit 16, then, data is transferred to the audio signal processing unit 16 through the input and output processing unit 15. At this time, for example, as the data amount per unit time read out from the audio data transmission and reception buffer 12 (progress speed of the readout address) is reduced, the data amount necessary for unit playback time is small, namely, compression rate is high. The bit rate is decided corresponding to the compression rate. Therefore, it is possible to find the bit rate btr by monitoring a state of reading out data (progress speed of the readout address) in the actual audio data transmission and reception buffer 12 when the correspondence between the actual progress speed of the readout address and the compression rate is found.

Then, in the next Step S302, the throughput value Exfer is found by the following formula 3.

$$Exfer=brt*k \quad \text{(Formula 3)}$$

A coefficient "k" in the formula 3 is a number larger than 1, and, in order to secure good transmission of the audio signal data of the bit rate "brt", it should be set so as to give a margin more than a fixed rate to the bit rate "brt".

The explanation returns to FIG. 8. For example, after the throughput value Exfer is calculated in the manner as described in FIG. 9 in Step S203, next, a throughput ratio "R" is calculated by the following formula 4 by using the throughput value Exfer in Step S204 and the throughput value Cxfer acquired in Step S202.

$$R=Cxfer/Exfer \quad \text{(Formula 4)}$$

In the next Step S205, concerning the throughput ratio "R" calculated in Step S204, whether R>1 or not is determined. Here, "R>1" means that the current actual throughput (effective communication speed) exceeds the throughput which is minimally necessary for audio signal data receiving at present. In the embodiment, the case of "R>1" is regarded as the case in which the power consumption amount can be reduced by switching the prescribed communication speed to, for example, slower speed, and after Step S206, a new optimum prescribed communication speed is found and whether the reduction of the power consumption amount is expected by that optimum prescribed communication speed or not is verified. On the other hand, when the negative determination result indicating that "R>1" is not true is obtained in Step S205, the procedure after Step S206 is omitted and the process proceeds to Step S213.

In Step S206, a new prescribed communication speed Erate is found. As a method of finding the optimum prescribed communication speed Erate in this step, for example, calculation of Crate/R is performed first. Then, a speed value which is on or more than a calculated value of Crate/R as well as the minimum speed value in the twelve stages prescribed communication speeds is determined as the optimum prescribed communication speed Erate. The optimum prescribed communication speed Erate calculated as the above is the slowest prescribed communication speed, for example, within the range more than the throughput value Exfer. That is, the optimum prescribed communication speed will be the speed which is minimally necessary for assuring transmission of audio content file data received at present.

After the new optimum prescribed communication speed is found in the manner as described above, a procedure for fining a power consumption amount "P" in the case that communication is performed in the optimum prescribed communication speed is executed. For that purpose, in Step S207, a standard communication time ratio α between prescribed communication speed Crate and the prescribed communication speed Erate is calculated. In order to calculate this, standard communication times respectively correspond to the prescribed communication speeds Crate and Erate are acquired by referring to the communication speed correspondence characteristic table shown in FIG. 6. Then, the standard communication time ratio α is calculated by the following formula 5 when, for example, the standard communication time corresponding to the prescribed communication time Crate is Cstt and the standard communication time corresponding to the prescribed communication speed Erate is Estt.

$$\alpha=Estt/Cstt \quad \text{(Formula 5)}$$

In the next Step S208, a retry occurrence probability difference β between the prescribed communication speed Crate and the prescribed communication speed Erate is calculated. To calculate the retry occurrence probability difference β, the communication speed correspondence characteristic table is referred again. After retry occurrence probabilities respectively corresponding to the prescribed communication speeds Crate and Erate are acquired, the calculate the retry occurrence probability difference β is calculated by the following formula 6 when, for example, the retry occurrence probability corresponding to the prescribed communication speed Crate is Crty and the retry occurrence probability corresponding to the prescribed communication speed Erate is Erty.

$$\beta=Erty-Crty \quad \text{(Formula 6)}$$

Next, In Step S209, integration of transmission time (estimated integrated transmission time eTtx), integration of reception time (estimated integrated reception time eTrx) and integration of power save time (estimated integrated power save time eTid) which are estimated in the case that communication is performed for a time length (Tp) of the power measurement period at the optimum prescribed communication speed Erate are respectively calculated by formulas below.

$$eTtx=Ttx*\alpha*\beta \quad \text{(Formula 7)}$$

$$eTrx=Trx*\alpha*\beta \quad \text{(Formula 8)}$$

$$eTid=Tp-(eTtx+eTrx) \quad \text{(Formula 9)}$$

In Step S210, the power consumption amount "P" is calculated, which is estimated in the case that communication is performed for a time length (Tp) of the power measurement period at the optimum prescribed communication speed Erate by using values of respective parameters calculated in Step S209 by a formula below.

$$P=(eTtx*Ptx[\text{Erate}])+(eTrx*Prx[\text{Erate}])+(eTid*Pid[\text{Erate}]) \quad \text{(Formula 10)}$$

In the next Step S211, as a final confirmation, concerning the power consumption amount "P" corresponding to the optimum prescribed communication speed Erate which has been calculated as the above and the power consumption amount Pc corresponding to the current prescribed communication speed Crate which has been calculated as in the precedence Step S201, whether "P<Pc" is true or not is determined. Specifically, determination whether the power consumption amount is reduced in the case of the optimum prescribed communication speed Erate as compared with the case of the current prescribed communication speed Crate or not is determined. When a negative result is obtained in Step S211, the process proceeds to Step S213. In Step S213, a determination result of "not necessary" is outputted as the determination result concerning necessity for changing setting of prescribed communication speed. On the other hand, when an affirmative result is obtained in Step S211, a determination result "necessary" is outputted as a determination result concerning necessity for changing setting of the prescribed communication speed in Step S212.

The explanation returns to FIG. 7. After the procedure shown in FIG. 8 as Step S108 is executed, whether the change of prescribed communication speed is necessary or not is determined in Step S109. That is to say, either the "necessary" or "not necessary" was outputted as the determination result for the necessity for changing setting of the prescribed communication speed is determined by the procedure of FIG. 8. In Step S109, when a negative determination result that the change of prescribed communication speed is not necessary is obtained, the process returns to, for example, the procedure of Step S102. On the other hand, when an affirmative determination result that the change of prescribed communication speed is necessary is obtained, the process proceeds to Step S110, and processing for establish wireless LAN communication at the optimum prescribed communication speed Erate calculated at this time is executed. For example, in the case of the system configuration shown in FIG. 1, the wireless LAN communication at the optimum prescribed communication speed Erate is established between the audio playback device 1 and the wireless LAN access point 3.

For example, in specifications supporting wireless LAN standards, the transmission side performs transmission with information designating the prescribed communication speed set at the present being stored in a predetermined position in a packet, and the reception side sets the corresponding prescribed communication speed by referring the information to match the communication speed. However, when the procedure of S110 is executed, the audio playback device 1 is in a state of receiving data of the audio content file. Therefore, basically, the side of the audio playback device 1 is in a state that it is difficult to transmit information of designating prescribed communication speed to take the initiative in control of the prescribed communication speed. Therefore, in Step S110, for example, the prescribed communication speed of the data transmission side (wireless LAN access point 3) is switched correspond to the optimum prescribed communication speed set by the audio playback device 1 as the data reception side to establish wireless LAN communication at the optimum prescribed communication speed Erate, as described below. The audio playback device 1 does not particularly perform data transmission when receiving data of the audio content file as described above, however, the audio playback device 1 returns an ACK (ACKnowlegment) to confirm normal reception of the packet. In Step S110, when the ACK in response to the reception of the data packet of the audio content file is returned, the transmission of the ACK is performed by setting a communication operation mode at the optimum prescribed communication speed Erate newly calculated. Then, the wireless LAN access point 3 detects that the communication speed when the ACK is transmitted is different from the last time at the reception of the ACK. The wireless LAN access point 3 determines that, for example, a situation in which the communication speed has to be switched on the reception side occurs due to some reason, and switches the data transmission operation mode with respect to the audio playback device 1 to the prescribed communication speed corresponding to the communication speed at the transmission of the ACK. It is also conceivable that the audio playback device 1 does not return an ACK even when the data packet of the audio content file is normally received on the side of the audio playback device 1. If the ACK is not returned, the wireless LAN access point 3 determines that a reception error occurs on the side of the audio playback device 1, and transmits the data packet again while switching the prescribed communication speed to be slow until obtaining the return of the ACK. The audio playback device 1 starts to return the ACK at the stage when data transmission from the wireless LAN access point 3 is performed at the prescribed communication speed matched to the optimum prescribed communication speed Erate. Accordingly, in the embodiment, the communication between the audio playback device 1 and the correspondent device (wireless LAN access point 3) in a mode in which the prescribed communication speed Erate is set is established. By performing either of the operations, it is possible that even the audio playback device 1 which does not take the initiative in setting the prescribed communication speed originally as the data reception side establishes communication in the communication speed corresponding to the optimum prescribed communication speed Erate by allowing the correspondent device to change the setting of communication speed. From another angle, the setting of communication speed corresponding to the optimum prescribed communication speed Erate is completed by execution of operation on the side of the audio playback device 1, it is not particularly necessary for the correspondent device (in this case, the wireless LAN access point 3) with respect to the audio playback device 1 to change the configuration or to makes an addition to the configuration. That is, as the embodiment, when performing switching to the communication speed corresponding to the optimum prescribed communication speed Erate, the corresponding device which performs communication with the audio playback device 1 may be a common device which can perform communication by basic wireless LAN standards, a protocol supported by the audio playback device 1. This will be an advantage that, when the user actually makes the audio listening system including the audio playback device 1 of the embodiment, the user can select ordinary common wireless LAN support devices at high degree of freedom concerning the wireless LAN devices other than the audio playback device 1.

As the procedure of Step S110, the above both two processing steps are used. That is, first, the ACK is transmitted at the optimum prescribed communication speed Erate, and waiting is performed for a fixed period of time until the communication speed of the transmission side is switched to the speed corresponding to the optimum prescribed communication speed Erate. When the switching of the communication speed is not performed in the fixed period of time, next, the returning of ACK is stopped to reduce the communication speed on the side of transmission to the optimum prescribed communication speed Erate. In the case that the transmission side takes the initiative in the whole control of setting communication speed, for example, as specifications of the wireless LAN device, it is conceivable that the transmission side does not respond to the processing performed by transmitting the ACK at the optimum prescribed communication speed Erate. Even so, for example, problems such as extreme reduction of throughput on the network do not particularly occur. On the other hand, in the control in which the error generation state is tentatively generated by not returning the ACK to reduce communication speed on the transmission side, the reduction of throughput on the network may occur because retransmission of data is repeated during the control. However, the operation that the transmission side reduces communication speed so as to correspond to the optimum prescribed communication speed can be positively obtained according to the specifications of the wireless LAN communication. Therefore, when both two processing steps and controls are performed in the above order as Step S110, mutual disadvantages are compensated and advantages of both are effectively utilized.

After the procedure in the Step S110 was executed, sequentially, the process proceeds to Step S113, and determination whether communication in the optimum prescribed communication speed Erate has been established or not is performed. When an affirmative result is obtained, the DC power supply device Vcc to the modulation/demodulation circuits which are not necessary for communication operation at the prescribed communication speed set at present (namely, optimum prescribed communication speed) is stopped. That is, the system control unit 24 (CPU 25) maintains supply of DC power supply voltage Vcc by turning on the switch corresponding to the modulation/demodulation circuit used for communication at the prescribed communication speed set at present in the switches 46, 47 and 48 shown in FIG. 3, as well as stops supply of the DC power supply voltage Vcc by turning off the switches corresponding to remaining two modulation/demodulation circuits according to the respective outputs of the switch on/off control signals Ss1, Ss2, and Ss3. For example, a negative determination result is obtained in Step S113 because the transmission side does not change communication speed in response to Step S110 (or step S112) by some reason, the process proceeds to Step S115. In that case, the prescribed communication speed of itself is set again so as to correspond to communication speed set at present on the transmission side.

In the case that an affirmative determination result is obtained in the precedent Step S107, this means that the number of occurrence of collisions increases in this power measurement period, and it can be estimated that the cause thereof is that communication speed between the audio playback device 1 and the transmission side of audio content file data is reduced as compared with the last time. As communication speed is reduced, time necessary for transmitting and receiving a unit data amount becomes long, therefore, a possibility that the line is occupied when other devices start to perform communication. In this case, the prescribed communication speed which is higher than now is tried to be set. For that purpose, first, whether the current prescribed communication speed is the maximum speed (54 Mbps in IEEE802.11g) or not is determined. When an affirmative determination result is obtained here, it is difficult to be switched to the further higher prescribed communication speed, therefore, the process proceeds to the procedure of Step S102. On the other hand, when a negative determination result is obtained, the process proceeds to Step 112 and control processing for establishing communication with the transmission side in the prescribed communication speed which is higher than the current speed is executed. As an example of processing, operation of returning the data packet in accordance with the reception of packet data may be performed as usual. Then, the transmission side determines that the communication stability has enough latitude at the current communication speed, and performing data transmission of the audio content file by switching to higher communication speed. After executing the procedure of Step S112, the process proceeds to the procedure after Step S113 explained before.

As somewhat described when explaining the configuration of the audio playback device 1 in the precedent FIG. 2, the audio playback device 1 itself includes portions as a sound source such as the radio tuner 13 and the media drive 14 and can transmit audio signal data obtained at these sound source portions to external equipment via the wireless LAN (network). That is, audio signal data obtained by receiving and selecting a channel in the radio tuner 13 or audio signal data played back from a medium mounted on the media drive 14 is transferred to the audio data transmission and reception buffer 12 via the input and output processing unit 15. If necessary, audio signal data obtained in the radio tuner 13 or the media drive 14 is transferred from the input and output processing unit 15 to the audio signal processing unit 16 once, and audio compression and encoding processing corresponding to the predetermined system is executed here, then, the compressed and encoded audio signal data is transferred to the audio data transmission and reception buffer 12 via the input and output processing unit 15 again. The system control unit 24 (CPU 25) sequentially reads out portions of audio signal data necessary for transmission from the audio data transmission and reception buffer 12 and performing processing for making packets and the like, then, transfers them to the wireless LAN communication unit 11, where modulation processing for wireless transmission is performed to the data to be transmitted as radio waves from the wireless LAN support antenna ANT1.

If the audio playback device 1 of the embodiment is capable of transmitting such audio signal data, an example can be conceived as an audio listening system in which, for example, two audio playback devices 1 perform wireless LAN communication, and audio signal data transmitted from one device is received by the other device to playback audio. Such wireless LAN communication can be easily realized by setting the communication mode to an ad hoc mode in the present circumstances. The communication of switching communication speed to the speed corresponding to the optimum prescribed communication speed which has been described above can be undoubtedly applied to the case in which the audio playback devices 1 perform communication with each other. That is because, as explained before, the operation for switching communication speed to speed corresponding to the optimum prescribed communication speed of the embodiment in the audio listening system is realized when the audio playback device 1 on the side receiving audio signal data just executes processing procedures explained with reference to FIG. 7 to FIG. 9 and the correspondent device just executes the operation of changing setting of communication speed in accordance with ordinary wireless LAN communication specifications according to the processing procedures (especially Step S110). Accordingly, for example, when the audio playback device 1 performs transmission of audio signal data using the direct wireless LAN communication by the ad hoc mode and the like with the audio server device 2 not via the access point and the like, as described above, the operation for switching communication speed to speed corresponding to the optimum prescribed communication speed of the embodiment can be undoubtedly realized.

The invention is not limited only to the configuration which has been described as the embodiment. For example, in the embodiment, the supply of DC power supply voltage Vcc is stopped for reducing the power consumption in the modulation/demodulation circuits not performing effective operation. That is, in the embodiment, operation of the modulation/demodulation circuits not performing completely effective operation is stopped. However, in addition to this, it is conceivable that an operation mode to be an extremely low power state even when the power is supplied such as a sleep mode is applied. In order to apply such mode, for example, further part of predetermined function circuit portions and the like may be selected in the modulation/demodulation circuit to stop the power supply, or an operation clock for a portion executing digital signal processing is switched to be low in speed. In addition, in the of the embodiment described above, explanation has been made only for the circuit portions concerning carrier modulation/demodulation in portions for turning on/off of power supply, however, if there is a portion in which switching of the circuit is performed along with the switching of the prescribed communication speed, it is also preferable that on/off control of power supply is performed with respect to such portion. Moreover, a configuration of the audio playback device 1 may be appropriately changed when it is configured to be capable of receiving audio signal data via the wireless LAN and performing audio playback. For example, in the configuration of FIG. 2, received audio signal data is played back merely in streaming playback, however, it is conceivable that a configuration in which the received audio signal data is stored, and played back audio in an opportunity after the data was received and acquired can be conceived. The audio playback device 1 of the embodiment can be driven by a battery, and as an effect by reducing power consumption amount according to the communication speed control based on the embodiment of the invention, the effect that battery lifetime is extended is particularly appealed. However, it is desirable that the power consumption amount is reduced not only for the device of battery driving but also for the device driven by taking commercial AC power supply. Therefore, the embodiment of the invention is applied to devices operated by taking the commercial power supply as input, not limited to devices driven by batteries. In the embodiment, data communication is performed with another device in accordance with wireless LAN standards, however, data communication according to standards other than the wireless LAN is also preferable. In the embodiment, the optimum prescribed communication speed is calculated and set when audio signal data is transmitted, however, it is also applied to the case that not only audio content data but also video content data (video signal data) and the like are transmitted. For example, in the case that communication speed prescribed in the wireless LAN and the like becomes higher in the future and prescribed communication speed stages which are sufficiently high for a bit rate of video data can be prescribed, the embodiment of the invention can be easily realized and useful corresponding to video contents. In the embodiment, the case of performing content data transmission is performed by wireless data communication is cited as the example, however, the embodiment can be applied to the transmission by wired data communication when, for example, it is the communication in which modulation method for transmission is prescribed to be switched according to the setting of communication speed. As technologies, standards and the like for transmitting content data such as audio and video by using data communication, for example, DLNA (Digital Living Network Alliance) and the like are well-known, which can be easily realized in the present circumstances.

It should be understood by those skilled in the art that various modifications, combinations, sub-combinations and alterations may occur depending on design requirements and other factors insofar as they are within the scope of the appended claims or the equivalents thereof.

What is claimed is:

1. A communication device, comprising:

a communication unit including plural function operation units performing communication with an external device at plural prescribed communication speeds, the plural prescribed communication speeds corresponding to data transfer rates of a wireless local area network; and a control unit configured to, allow the communication unit to receive a content data from the external device, estimate an optimum prescribed communication speed in which a power consumption amount becomes smallest from the plural prescribed communication speeds based on a bit rate of the content data, one of the plural prescribed communication speeds, and an actual communication speed calculated during the receiving of the content data, the bit rate corresponding to a compression rate of the content data, and the content data including at least one of audio and video multimedia content, select a given function operation unit from the plural function operation units based on the estimated optimum communication speed, allow the selected function operation unit to receive the content data at the estimated prescribed communication speed, and control power consumption to the function operation units other than the function operation unit selected from the plural function operation units to be less than a fixed value.

2. The communication device according to claim 1, wherein the control unit allows the function operation unit to transmit an affirmative response indicating a normal reception of the content data to the external device at the optimum prescribed communication speed.

3. The communication device according to claim 1, wherein the control unit allows the selected function operation unit to transmit an affirmative response indicating a normal reception of content data to the external device when the selected function operation unit receives the content data from the external device at the optimum prescribed communication speed.

4. The communication device according to claim 1, wherein the control unit detects occurrence of collisions in communication by the communication unit, and when it is determined that the occurrence frequency of collisions increased, allows the communication unit to receive content data at prescribed communication speed higher than the estimated optimum prescribed communication speed.

5. The communication device according to claim 1, further comprising:

a battery; and wherein the control unit supplies electric power from the battery to function operation units in the communication unit.

6. The communication unit according to claim 1, wherein the communication unit is a wireless communication unit.

7. The communication method according to claim 1, wherein the step of transmitting the affirmative response allows the selected function operation unit to transmit the affirmative response indicating a normal reception of content data to the external device when the selected function operation unit receives the content data from the external device at the optimum prescribed communication speed.

8. The communication device according to claim 1, wherein the control unit is further configured to switch off electric power to the function operation units other than the function operation unit selected, and the function operation units include modulation/demodulation circuits.

9. The communication device according to claim 1, wherein the control unit is further configured to allow the communication unit to receive list information of a plurality of available content data from the external device before receiving the content data, the list information including information of a bit rate of each of the plurality of available content data.

10. The communication device according to claim 1, wherein the communication unit including the plural function operation units perform communication with the external device through the wireless local area network.

11. The communication device according to claim 1, further comprising:

a storage unit configured to store, in an associated relationship in a table, the plural prescribed communication speeds, values of power consumption in transmission, values of power consumption in reception, values of standard communication time, and values of retry occurrence probability.

12. A communication method, comprising the steps of:

allowing a communication unit having plural function operation units performing communication at plural prescribed communication speeds to receive a content data from an external device, the plural prescribed communication speeds corresponding to data transfer rates of a wireless local area network;

estimating an optimum prescribed communication speed in which a power consumption amount becomes smallest from the plural prescribed communication speeds based on a bit rate of the content data, one of the plural prescribed communication speeds, and an actual communication speed calculated during the receiving of the content data, the bit rate corresponding to a compression rate of the content data, and the content data including at least one of audio and video multimedia content;

selecting a given function operation unit in the plural function operation units based on the estimated optimum prescribed communication speed;

allowing the selected function operation unit to receive the content data at the estimated prescribed communication speed; and controlling power consumption to the function operation units other than the selected function operation unit from the plural function operation units to be less than a fixed value.

13. The communication method according to claim 12, further comprising the step of:

allowing the function operation unit to transmit an affirmative response indicating a normal reception of the content data to the external device at the optimum prescribed communication speed.

14. The communication method according to claim 12, further comprising the steps of:

detecting occurrence of collisions in communication by the communication unit; and allowing the communication unit to receive content data at prescribed communication speed which is higher than the estimated optimum prescribed communication speed when it is determined that the occurrence frequency of collisions increased.

15. The communication method according to claim 12, further comprising the step of:

supplying electric power from a battery to the function operation units in the communication unit.

16. The communication method according to claim 12, wherein the communication unit is a wireless communication unit.

17. A non-transitory recording medium having computer executable instructions recorded thereon, wherein the instructions, when executed by a computer, cause the computer to perform a method comprising:

allowing a communication unit having plural function operation units performing communication at plural prescribed communication speeds to receive a content data from an external device, the plural prescribed communication speeds corresponding to data transfer rates of a wireless local area network;

estimating an optimum prescribed communication speed in which a power consumption amount becomes smallest from the plural prescribed communication speeds based on a bit rate of the content data, one of the plural prescribed communication speeds, and an actual communication speed calculated during the receiving of the content data, the bit rate corresponding to a compression rate of the content data, and the content data including at least one of audio and video multimedia content;

selecting a given function operation unit from the plural function operation units based on the estimated optimum prescribed communication speed;

allowing the selected function operation unit to receive the content data at the estimated prescribed communication speed; and controlling power consumption to the function operation units other than the selected function operation unit from the plural function operation units to be less than a fixed value.

18. The recording medium according to claim 17, further comprising:

allowing the function operation unit to transmit an affirmative response indicating a normal reception of the content data to the external device at the optimum prescribed communication speed.

19. The recording medium according to claim 17, wherein the step of transmitting the affirmative response allows the selected function operation unit to transmit the affirmative response indicating a normal reception of content data to the external device when the selected function operation unit receives the content data from the external device at the optimum prescribed communication speed.

20. The recording medium according to claim 17, further comprising:

detecting occurrence of collisions in communication by the communication unit; and allowing the communication unit to receive content data at prescribed communication speed which is higher than the estimated optimum prescribed communication speed when it is determined that the occurrence frequency of collisions increased.

21. The recording medium according to claim 17, further comprising:

supplying electric power from a battery to the function operation units in the communication unit.

22. The recording medium according to claim 17, wherein the communication unit is a wireless communication unit.

* * * * *